United States Patent [19]

Potts

[11] Patent Number: 4,662,290

[45] Date of Patent: May 5, 1987

[54] AUTOMATIC COAL STOKER

[75] Inventor: Kenneth F. Potts, Schuylkill Haven, Pa.

[73] Assignee: Keystoker, Inc., Schuylkill Haven, Pa.

[21] Appl. No.: 903,782

[22] Filed: Sep. 4, 1986

[51] Int. Cl.[4] ..... F23K 3/16

[52] U.S. Cl. ..... 110/109; 110/223; 110/231; 110/290; 110/327; 414/198

[58] Field of Search ..... 110/101 R, 102, 109, 110/114, 218–219, 223, 263, 267, 281–282, 286, 289, 290, 293, 298–300, 104 R, 105; 414/160, 187, 198, 304; 100/189, 292, 257; 241/600

[56] References Cited

U.S. PATENT DOCUMENTS

| | | | |
|---|---|---|---|
| 513,244 | 1/1894 | Newton | 110/281 |
| 1,201,664 | 10/1916 | Williams | 110/109 |
| 2,195,278 | 3/1940 | Leas | 110/109 |
| 4,328,786 | 5/1982 | Owen | 110/281 X |
| 4,537,140 | 8/1985 | Baker | 110/281 |

FOREIGN PATENT DOCUMENTS

| | | | |
|---|---|---|---|
| 107116 | 6/1984 | Japan | 110/109 |

*Primary Examiner*—Henry C. Yuen
*Assistant Examiner*—Steven E. Warner
*Attorney, Agent, or Firm*—Leonard M. Quittner

[57] ABSTRACT

An automatic coal stoker is disclosed having at the base of its hopper an enclosed reciprocating pusher assembly rectangular box shaped which delivers compressingly a defined but variable quantity of coal into a restricted passageway. Successive quantities form a compressed strip of coal to be burned between side rails of an inclined fire grate situate over an air box fed with a forced air supply. As the strip works its way down the inclined grate it burns without forming clinkers and discharges ashes at the bottom of the incline.

4 Claims, 7 Drawing Figures

FIG. 1
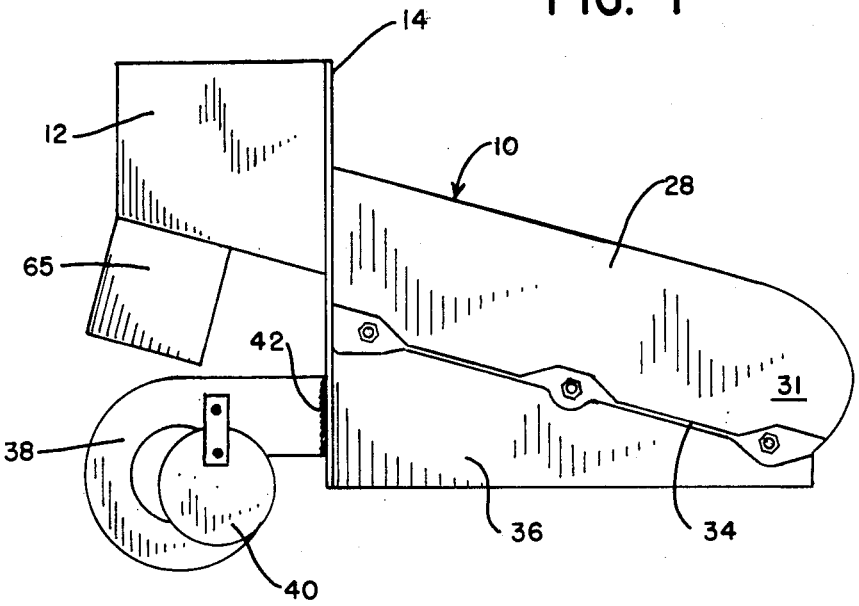
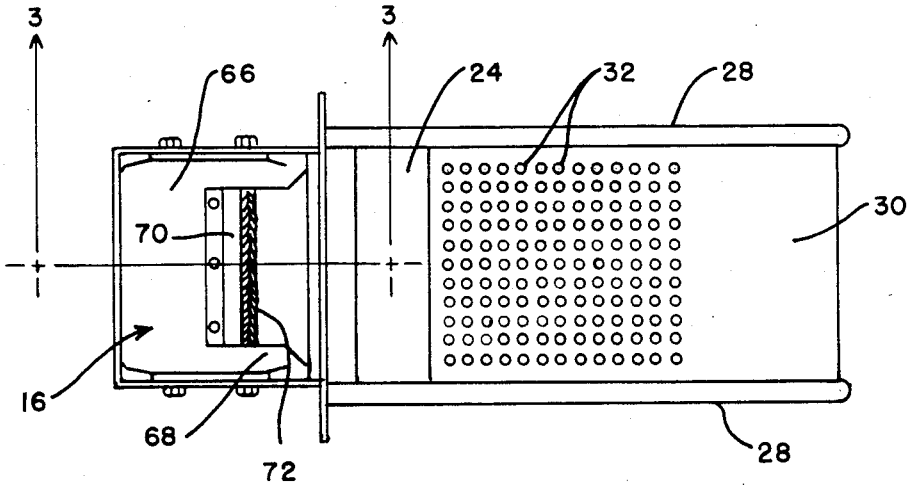
FIG. 2

FIG. 4
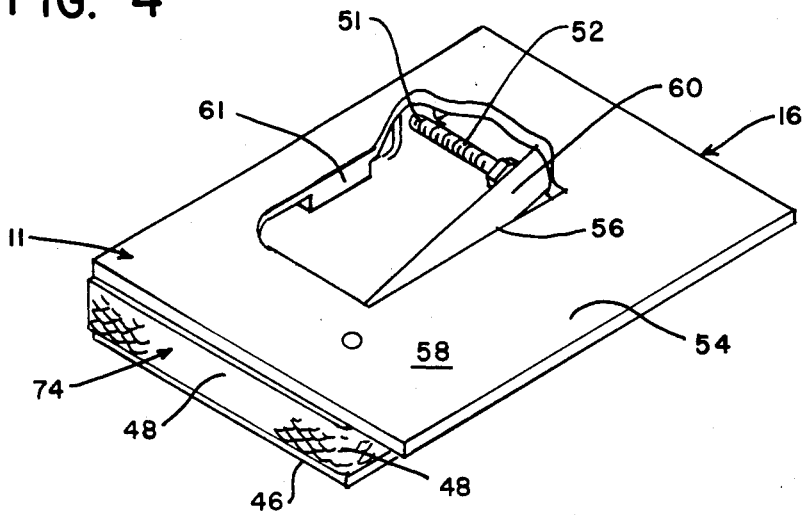
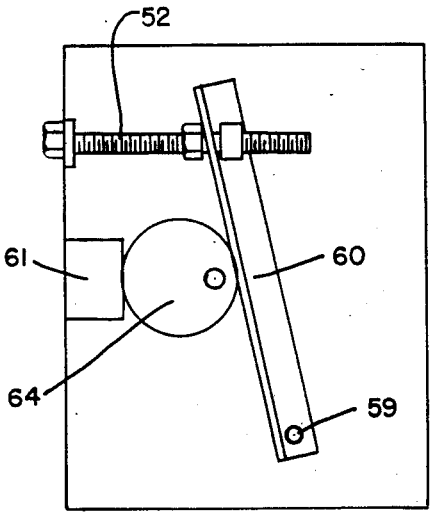
FIG. 5
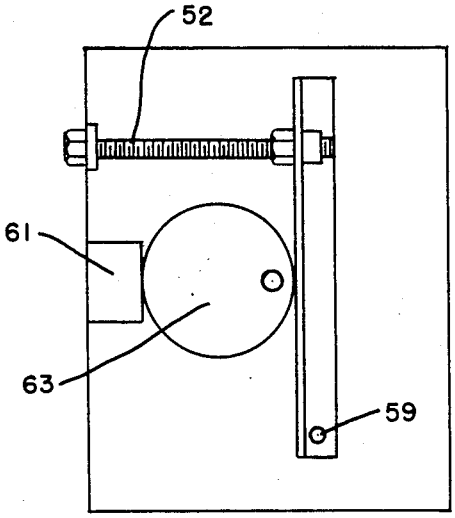
FIG. 6

AUTOMATIC COAL STOKER

BACKGROUND OF THE INVENTION

1. Field of the Invention

The field of the invention relates to an improved automatic coal stoker having an enshrouded pusher of variable stroke length and a means to break up or suppress clinker formation.

2. Description of the Prior Art

The prior art is best demonstrated by U.S. Pat. No. 4,537,140 to Baker which has at the bottom of the hopper a reciprocating, sliding plate with a lip at its rear forming a pusher bar, the plate of which tends to vibrate the infed coal and the pusher causing the coal to travel down an inclined fire grate. This configuration has no means, however, for accurate regulation of the amount of coal infed nor to break up or prevent the formation of clinkers. Pusher bars of variable reciprocating stroke are generally known. None, however are designed to keep the bar from contact with the coal or its fines. With wet coal or fines and the gases emitted in the burning thereof, sulfuric and nitric acid are formed which attack the pusher particularly and also cause jamming and excessive wear.

SUMMARY OF THE INVENTION

The invention described herein is summarized as an automatic coal stoker having a rear mounted coal hopper to receive, typically, rice sized anthracite coal. At the hopper's bottom is installed an enshrouded pusher assembly which is cam operated to impart to the pusher an intermittent reciprocating, sliding action with variable stroke capability whereby the coal is compacted into a restricted passage and shaped and squeezed therethrough continuously in compacted strip form onto a fire grate with side rails which grate is situated over an air box. The compacted coal is forced down the fire grate which is inclined at an optimum angle of 14 to 22 and more specifically at or about 18 to work best. The movement of the compacted coal will positively break up clinkers which inevitably form on the grate in other designs of stoker. In addition, coal ash is pushed off the grate for disposal.

An object of the invention is to regulate accurately the infeed of coal from hopper to grate to conserve it, to cause it to burn more efficiently and make it more responsive to thermostatic demand.

A further object of the invention is to provide an enshrouded pusher which is resistant to attack from the acids of combustion and coal fines.

A further object of the invention is to prevent or break up clinker formation in the fire grate automatically.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein seven (7) figures are shown on three (3) sheets. The numbers shown on the drawings for the various parts of the invention are consistent throughout so that a number indicating a part in one drawing will indicate the same part in another drawing.

FIG. 1 shows a side view of the stoker assembly;

FIG. 2 shows a top view thereof;

FIG. 4 shows the pusher as viewed from underneath;

FIG. 5 is a schematic view of the adjustment means of the stoker.

FIG. 6 shows how the stroke may be increased in length by enlarging the cam.

DESCRIPTION OF THE PREFERRED EMBODIMENT

The preferred embodiment is best described by summarizing generally its cooperating elements and providing details of certain elements as required for understanding.

The stoker (10) of the present invention has a rearward upright mounted hopper (12) made of sheet metal whose furnace side consists of a mounting flange (14). The hopper accepts and stores coal; typically rice-sized anthracite.

Figure 3:
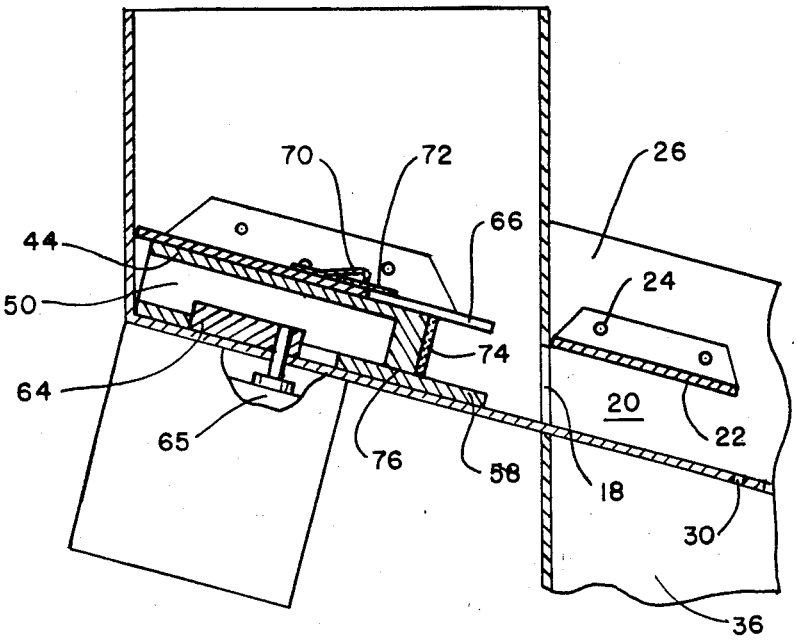
FIG. 3 is a cross-section view through line 3—3 in FIG. 2 with the pusher retracted.
Figure 3A:
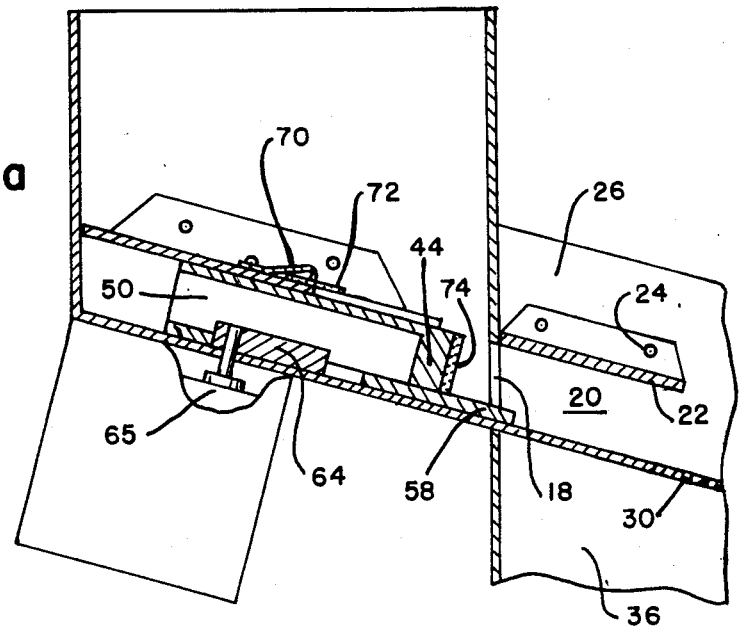
FIG. 3*a* is the same view with the pusher advanced.

At the bottom of the hopper is a covered pusher assembly (16) which is designed so as to be protected from the generally acidic atmosphere of combustion, particularly if lower grade or wet coal is used. The pusher has a variable stroke (see FIGS. 6) and intermittently slidingly reciprocates (see FIG. 3 and FIG. 3*a*). By this means the amount of infed coal is regulated and is squeezed compressingly through a port (18) in the flange and into a restricting passageway (20) defined by an upper grate cover (22) roofing over by bolt means (24) the passage whose sides are formed by upper portions (26) of side rails (28) the top of a fire grate (30) which is angled downward (31), typically at an angle of 14° to 22°, most preferably at 18 which ensures that the coal will not heap or run away over the fire grate which has a multiplicity of air holes (32) disposed therethrough. The grate forms the top (34) of an air box (36) which is forced air fed with typically a 100 CFM squirrel cage blower (38) whose air intake is made variable by a swivel cover plate (40). The blower is sealed at its output end to the intake of the air box by a gasket (42).

The pusher assembly is rectangular box shaped and has an upper casting (44) forming a top (46) and three sides (48), the side away from the flange (50) being open and holding a mounting (51) for a stroke adjusting screw (52). Bolted to the upper casting is a bottom plate (54) which has centrally disposed thereon a rectangular slot (56). The plate, which is somewhat longer than the top casting so as to form a step-like protuberance (58) at its flange side edge, encloses a pivotally mounted (59) angle bar (60) whose angle is adjusted by the stroke adjusting screw and which is intermittently in contact with cam (64) seated inside the pusher assembly box through the slot. The cam is attached to a gear motor (65) which typically turns at 1.33 RPM. The cam's rotation imparts a reciprocal sliding motion to the pusher assembly when installed by first striking and pushing the angle bar and then striking and pushing a boss (61) cast into the top plate and necessarily a vibratory motion to the hopper. The angle bar when adjusted in its angle by the adjusting screw regulates the length of the stroke of the pusher assembly and thereby regulates the amount of infed coal into the passage.

The pusher assembly is mounted under a protective pusher cover plate (66) which forms the bottom of the hopper. The plate has formed in its flange side edge a "U" shaped notch (68) which holds a wiper (70), typically of a woven fabric (72) of fiberglas or asbestos which prevents coal fines from being dragged under the cover plate during reciprocations thereby keeping the pusher assembly from being jammed by overladen coal or fines.

Similar wiper material (74) is wrapped encasingly around the three sides of the pusher assembly further protecting it from fines, gases, the acidic atmosphere of combustion or wetness of coal.

In operation, at the start, after a fire is started on the grate a defined quantity of rice coal is found on the step in front of the pusher which quantity is squeezed compressingly into the passage and held by its restriction. Successive quantities of coal are deposited into the passage with each reciprocation cycle pushing the previous deposit further into the passage. The result of successive deposits is the ejection from the passage of a continuous strip of compressed coal of rectangular cross-section which works its way down the incline of the fire grate between the side rails. In this way, as combustion takes place on the grate clinkers can not form and ash is continuously cleared from the grate.

As may be understood, the amount of coal delivered for burning can be varied from zero to typically six (6) pounds per hour based on cam size (see FIG. 5 and FIG. 6), at a maximum and forced air flow regulated accordingly to ensure complete burning. Stack temperature measurements tend to show that up to eighty-five percent (85%) use of generated BTU's is quite possible, demonstrating a high degree of efficiency. Of course, the principles involved in the current invention would allow for the construction of a much larger capacity stoker than the one disclosed.

It may also be seen that the present invention is readily adapted to thermostatic control by attaching to both the gear motor and blower appropriate switches and signalling means.

Since many modifications, variations and changes in detail may be made to the presently described embodiments, it is intended that all matter in the foregoing description and accompanying drawings be interpreted as illustrative and not by way of limitation.

What claimed is:

1. A hopper fed automatic coal stoker, the combination comprising:

a. a rear mounted upright hopper having a furnace side mounting flange and a bottom which is formed by an enshrouding pusher cover over b. a slidingly reciprocating rectangular box shaped pusher assembly with an intermittent adjustable stroke consisting of an upper casting which forms the top and three enclosed sides of the box, a fourth side, rearward, being open and a bottom plate which is longer than the top casting such that a flange side step is formed forward of the box, the bottom plate having centrally disposed therein a slot to receive a cam whose rotation is supplied by an inferiorly mounted gear motor; the cam being disposed against pivotally mounted angle bar contained in the box such that such that an intermittent reciprocation adjustment may be made in its length of stroke by an angle adjusting screw mounted and accessible for adjustment from the open side of the box; the pusher assembly in its reciprocation pushing a defined quantity of coal from the step compressingly through c. a port in the flange into a restricting passage formed at its top by a cover plate and at its sides by the upper portions of side rails of an inclined fire grate having a multiplicity of holes therein which grate forms the top of an air box which receives an adjustable supply of forced air.

2. An automatic stoker as in claim 1 wherein the pusher cover is notched to contain a wiper which prevents coal from contacting the pusher assembly top during reciprocation.

3. An automatic stoker as in claim 1 in which the fire grate is inclined at an angle of from 14 to 22 degrees.

4. An automatic stoker as in claim 3 in which the incline is 18 degrees.

* * * * *